US006376979B1

(12) United States Patent
Komori et al.

(10) Patent No.: US 6,376,979 B1
(45) Date of Patent: Apr. 23, 2002

(54) COLOR CATHODE RAY TUBE MOVING TWO INNER CONDUCTIVE LAYER WITH DIFFERENT RESISTANCE

(75) Inventors: Itsuro Komori; Osamu Adachi; Yasunori Miura; Toshiaki Katano, all of Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/490,214

(22) Filed: Jan. 24, 2000

(30) Foreign Application Priority Data

Jan. 28, 1999 (JP) ..... 11-019476

(51) Int. Cl.[7] ..... H01J 29/80
(52) U.S. Cl. ..... 313/404; 313/402; 313/477 R
(58) Field of Search ..... 313/402, 404, 313/477 R, 479, 313

(56) References Cited

FOREIGN PATENT DOCUMENTS

JP 59-171439 9/1984

*Primary Examiner*—Vip Patel
(74) *Attorney, Agent, or Firm*—Merchant & Gould PC

(57) ABSTRACT

The present invention relates to a color cathode ray tube that reduces a leakage electric field and a maximum instantaneous current generated in a bulb at the time of electric discharge and provides a stable connection of conductive layers with different specific resistance. A first conductive layer is formed on the entire area of an inner wall of a funnel including a contact portion of a first spring supported by a shadow mask structure, an anode button and a contact portion of a second spring supported by a final electrode of an electron gun. A second conductive layer with a specific resistance lower than that of the first conductive layer is formed on the surface of the first conductive layer within the range extending from the anode button to the contact portion of the first spring. The contact portion of the first spring contacts the second conductive layer, thereby electrically connecting the shadow mask structure to the second conductive layer, and the contact portion of the second spring contacts the first conductive layer, thereby electrically connecting the final electrode to the first conductive layer.

5 Claims, 5 Drawing Sheets

COLOR CATHODE RAY TUBE MOVING TWO INNER CONDUCTIVE LAYER WITH DIFFERENT RESISTANCE

FIELD OF THE INVENTION

The present invention relates to a color cathode ray tube used in a picture display device such as a television receiver or a computer display and a method for manufacturing the same.

BACKGROUND OF THE INVENTION

FIG. 5 shows an example of a conventional cathode ray tube. This cathode ray tube includes a bulb 7, a shadow mask structure 9 and an electron gun 10 as main elements.

The bulb 7 includes a panel 2 and a funnel 6. The panel 2 has a phosphor screen 1 on its inner surface. The funnel 6 has a conductive layer 4 on its inner wall 3 and an anode button 5 for applying a high voltage to the conductive layer 4. The conductive layer 4 includes a conductive layer 4*a* located between the anode button 5 and the electron gun 10, a conductive layer 4*b* located on the side of the panel 2 and a conductive layer 4*c* located on the side of a neck portion 6*a*. The shadow mask structure 9 has a shadow mask 8 facing the phosphor screen 1 on the inner surface of the panel 2. The neck portion 6*a* of the funnel 6 encloses the electron gun 10.

The shadow mask structure 9 is provided with the first spring 11. The first spring 11 has a contact portion 11*a*. The contact portion 11*a* contacts the conductive layer 4 on the inner wall 3 of the funnel, thereby electrically connecting the shadow mask structure 9 to the conductive layer 4. A final electrode 110 of the electron gun 10 is provided with the second spring 12. The second spring 12 has a contact portion 12*a*. The contact portion 12*a* contacts the conductive layer 4 on the inner wall 3 of the funnel, thereby electrically connecting the final electrode 110 to the conductive layer 4.

The cathode ray tube described in Publication of Japanese Unexamined Patent Application (Tokkai) No. Sho 59-171439, having a configuration such as shown in FIG. 5, is configured so that the conductive layer 4*a* located between the anode button 5 and the electron gun 10 has a specific resistance of 0.1 to 10 Ωcm, and the conductive layer 4*b* located on the side of the panel 2 and the conductive layer 4*c* located on the side of the neck portion 6*a* have a specific resistance of 0.1 Ωcm or less. The above configuration reduces a maximum instantaneous current generated between electrodes in the bulb at the time of a spark, and thereby prevents individual circuit components in TV sets from malfunctioning and breaking.

In such a color cathode ray tube, a sequence of the conductive layer 4*c*, the conductive layer 4*a* and the conductive layer 4*b* is formed on the inner wall 3 of the funnel, in the direction of an electron beam emitted from the electron gun 10. Therefore, a junction portion A of the conductive layer 4*a* and the conductive layer 4*c* becomes step-wise, as does a junction portion B of the conductive layer 4*a* and the conductive layer 4*b*. In other words, both edge portions of the conductive layer 4*a* are formed over different planes rather than on the same plane. One edge portion of the conductive layer 4*a* is formed on two different planes of the inner wall 3 of the funnel and the conductive layer 4*c*. The other edge portion of the conductive layer 4*a* is formed on two different planes of the inner wall 3 of the funnel and the conductive layer 4*b*. Consequently, the junction portions A and B have had problems such as poor conductivity, clogs of apertures of the shadow mask 8 due to shedding off of layers or electric discharges in the tube. Also, the conductive layers 4*a*, 4*b* and 4*c* having different specific resistance are formed extensively on planes with different shapes in the inner wall 3 of the funnel 6, resulting in the complexity of the manufacturing steps.

In addition, in recent years, there has been a concern that leakage electric field emitted from a TV set having a color cathode ray tube might be harmful to the human body. Accordingly, VLEF (Very Low Electric Field) standards have been adopted for regulations (the standardized electric field value is up to 1.0 V/m in a horizontal deflection frequency of 2 to 400 kHz).

SUMMARY OF THE INVENTION

It is an object of the present invention to provide a color cathode ray tube and a method for manufacturing the same that reduces a leakage electric field and a maximum instantaneous current generated in a bulb at the time of electric discharge and realizes a stable connection of conductive layers with different specific resistance.

The color cathode ray tube according to the present invention is an improvement of a color cathode ray tube including a bulb having a panel with a phosphor screen disposed on an inner surface thereof and a funnel, a shadow mask structure having a shadow mask that is provided in opposition to the phosphor screen on the inner surface of the panel, an electron gun enclosed in a neck portion of the funnel, a conductive layer provided on an inner wall of the funnel, an anode button provided in the funnel and used for applying high voltage to the conductive layer, a first spring supported by the shadow mask structure and having a contact portion that is biased against the conductive layer, and a second spring supported by a final electrode of the electron gun and having a contact portion that is biased against the conductive layer. The conductive layer includes a first conductive layer and a second conductive layer having a specific resistance lower than that of the first conducive layer. The first conductive layer is formed on an entire range of the inner wall of the funnel to be provided with the conductive layer. The second conductive layer is formed on the first conductive layer within a range from the anode button to the contact portion of the first spring. The contact portion of the first spring contacts the second conductive layer, thereby electrically connecting the shadow mask structure to the second conductive layer. The contact portion of the second spring contacts the first conductive layer, thereby electrically connecting the electrode to the first conductive layer.

With this configuration, since the second conductive layer is formed on a single surface of the first conductive layer, the connection of conductive layers with different specific resistance is firm. In addition, by setting a specific resistance of the second conductive layer lower than that of the first conductive layer, a current pulse, which is generated when an electron beam collides with the shadow mask, easily runs from the anode button to the contact portion of the first spring via the second conductive layer as a lower resistance portion. Consequently, the emission of electric field is suppressed, thus reducing the leakage electric field. In addition, with the first conductive layer that forms a higher resistance portion being connected to the contact portion of the final electrode, the maximum instantaneous current generated between electrodes in the bulb at the time of a spark can be reduced.

In the above configuration, it is desirable that the first conductive layer has a specific resistance of 1 to 3 Ωcm.

It is also desirable that the second conductive layer has a specific resistance of 0.05 to 0.2 Ωcm.

Furthermore, it is desirable that the first conductive layer is made of a material mainly containing graphite and titanium oxide and the second conductive layer is made of a material mainly containing graphite.

In accordance with the present invention, a method to manufacture the color cathode ray tube with the above configuration includes forming the first conductive layer on the inner wall of the funnel, applying a conductive coating with a specific resistance lower than that of the first conductive layer on the first conductive layer between the anode button and the contact portion of the first spring, and drying the conductive coating to form the second conductive layer.

With this method, since the second conductive layer is formed on a single surface of the first conductive layer, a stable connection between the first and second conductive layers can be obtained and the manufacturing steps of forming each conductive layer can be simplified.

DESCRIPTION OF THE PREFERRED EMBODIMENTS

The following is a description of the preferred embodiments of the present invention, with reference to the accompanying drawings.

Figure 1:
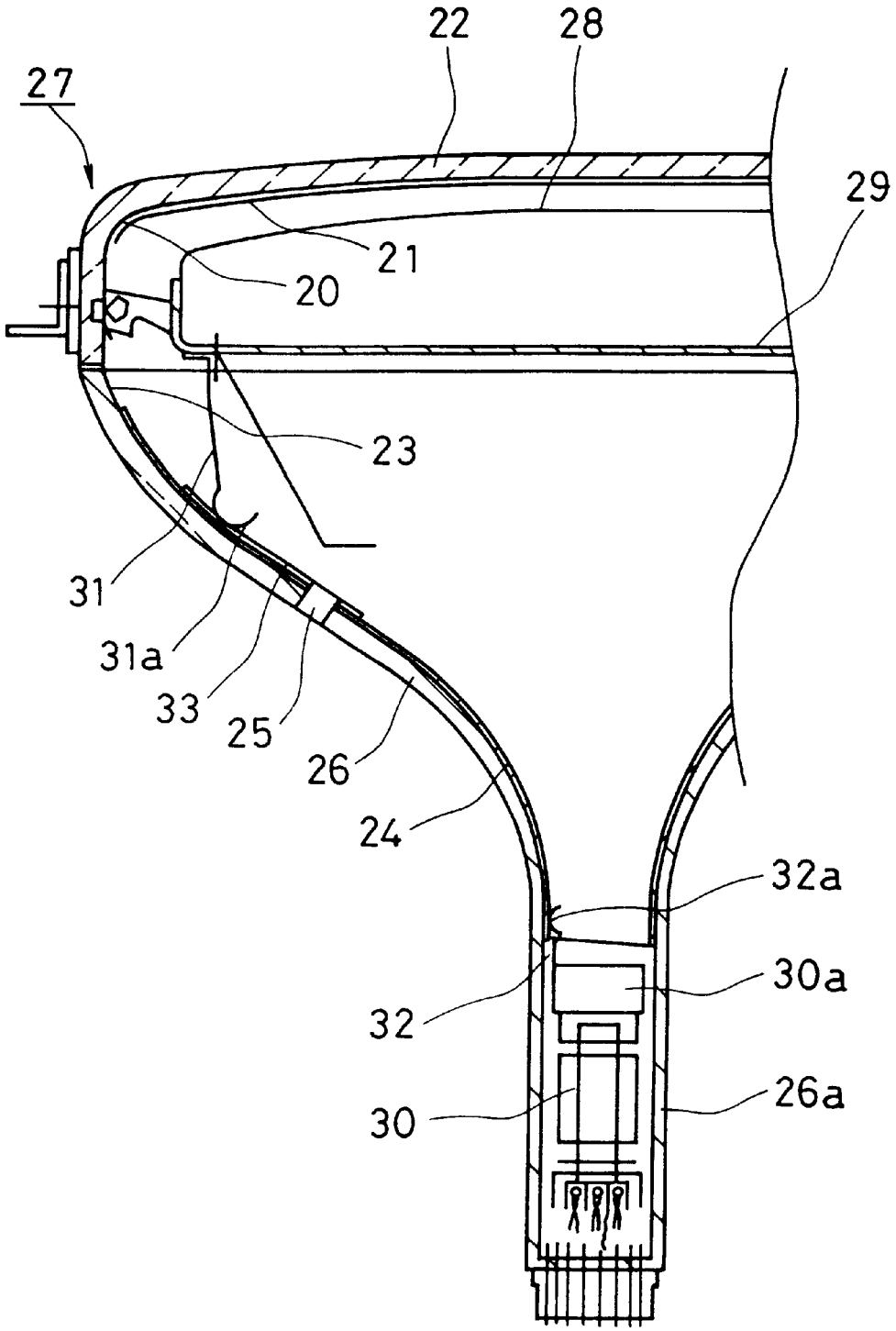
FIG. 1 is a cross-sectional view of a color cathode ray tube in accordance with the embodiment of the present invention.

As is shown in FIG. 1, a color cathode ray tube in accordance with the embodiment of the present invention includes a bulb 27, a shadow mask structure 29 and an electron gun 30.

The bulb 27 includes a panel 22 and a funnel 26. The panel 22 has a phosphor screen 21 on its inner surface 20. The funnel 26 has a first conductive layer 24 on its inner wall 23 and an anode button 25 for applying a high voltage to the first conductive layer 24. The shadow mask structure 29 has a shadow mask 28 facing the phosphor screen 21 on the inner surface 20 of the panel. The neck portion 26*a* of the funnel 26 encloses the electron gun 30.

The shadow mask structure 29 is provided with a first spring 31. The first spring 31 has a contact portion 31*a*. The contact portion 31*a* is biased against an inner wall 23 of the funnel. On the portion of the first conductive layer 24 between the contact portion 31*a* and the anode button 25, a second conductive layer 33 with a specific resistance lower than that of the first conductive layer 24 is formed. Thus, the contact portion 31*a* is in contact with the second conductive layer 33, thereby electrically connecting the shadow mask structure 29 to the conductive layer 33 and then to the anode button 25 via the conductive layer 33.

A final electrode 30*a* of the electron gun 30 is provided with a second spring 32. The second spring 32 has a contact portion 32*a*. The contact portion 32*a* contacts the first conductive layer 24 on the inner wall 23 of the funnel, thereby electrically connecting the final electrode 30*a* to the conductive layer 24.

With above configuration, the anode button 25 and the contact portion 31*a* of the first spring 31 form a low resistance portion that is electrically connected by the second conductive layer 33. On the other hand, the anode button 25 and the contact portion 32*a* of the second spring 32 form a high resistance portion that is electrically connected by the first conductive layer 24.

The first conductive layer 24 may be set to have a specific resistance of 1 to 3 Ωcm to reduce the maximum instantaneous current generated in the bulb 27 at the time of electric discharge, while the second conductive layer 33 may be set to have a specific resistance of 0.05 to 0.2 Ωcm to reduce the leakage electric field.

The first spring 31 and the second spring 32 can be formed with elastic metal plates made of stainless materials. The contact portions 31*a* and 32*a* are formed so as to have, for example, a spherical surface in order not to damage the conductive layers 24 and 33.

A method for manufacturing the color cathode ray tube according to the present invention is characterized especially by a conductive layer forming step among the other steps of manufacturing the color cathode ray tube. In the conductive layer forming step, conductive coatings are applied onto the inner wall 23 of the funnel, thereby forming the first conductive layer 24 and the second conductive layer 33. Since other steps such as a phosphor screen forming step and a frit step are the same as the ones widely known, an explanation here is omitted.

Figure 2:
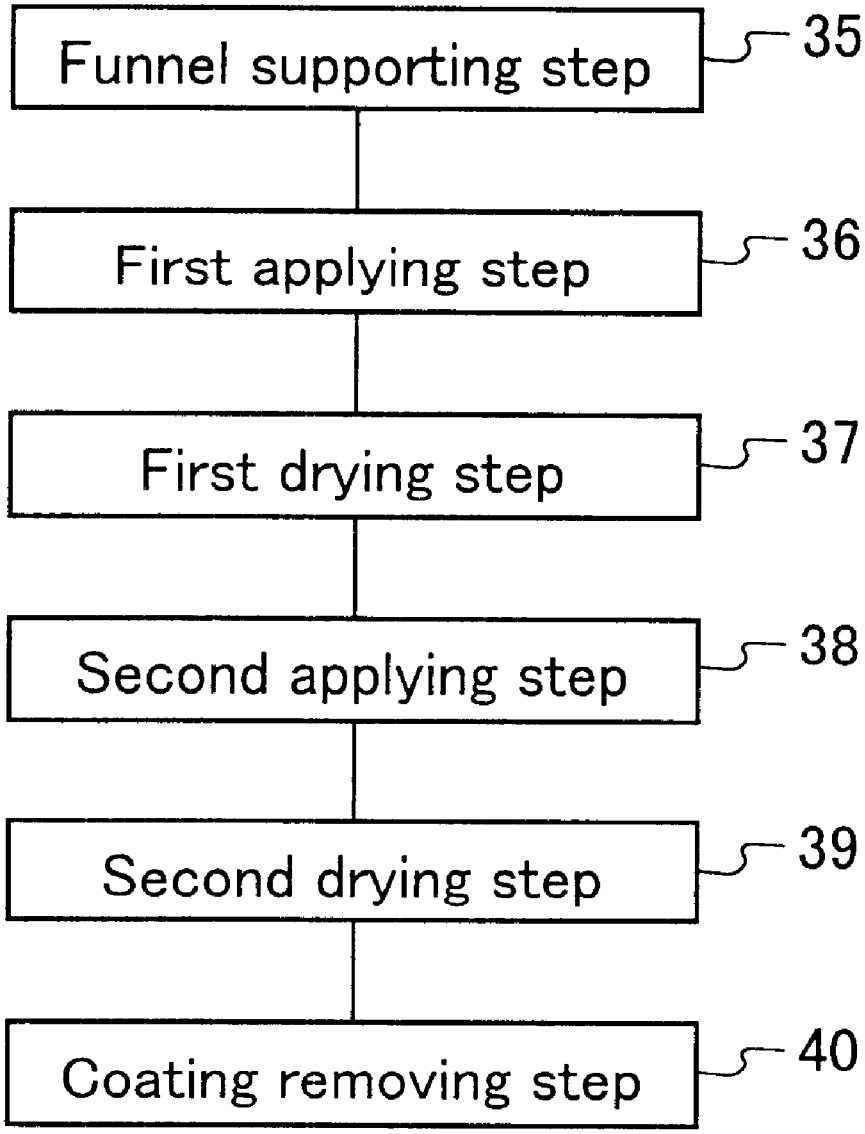
FIG. 2 is a block diagram showing steps of manufacturing the cathode ray tube.

The conductive layer forming step includes the steps shown in FIG. 2. A sequence of a funnel supporting step 35, a first applying step 36, a first drying step 37, a second applying step 38, a second drying step 39 and a coating removing step 40 is performed.

Figure 3:
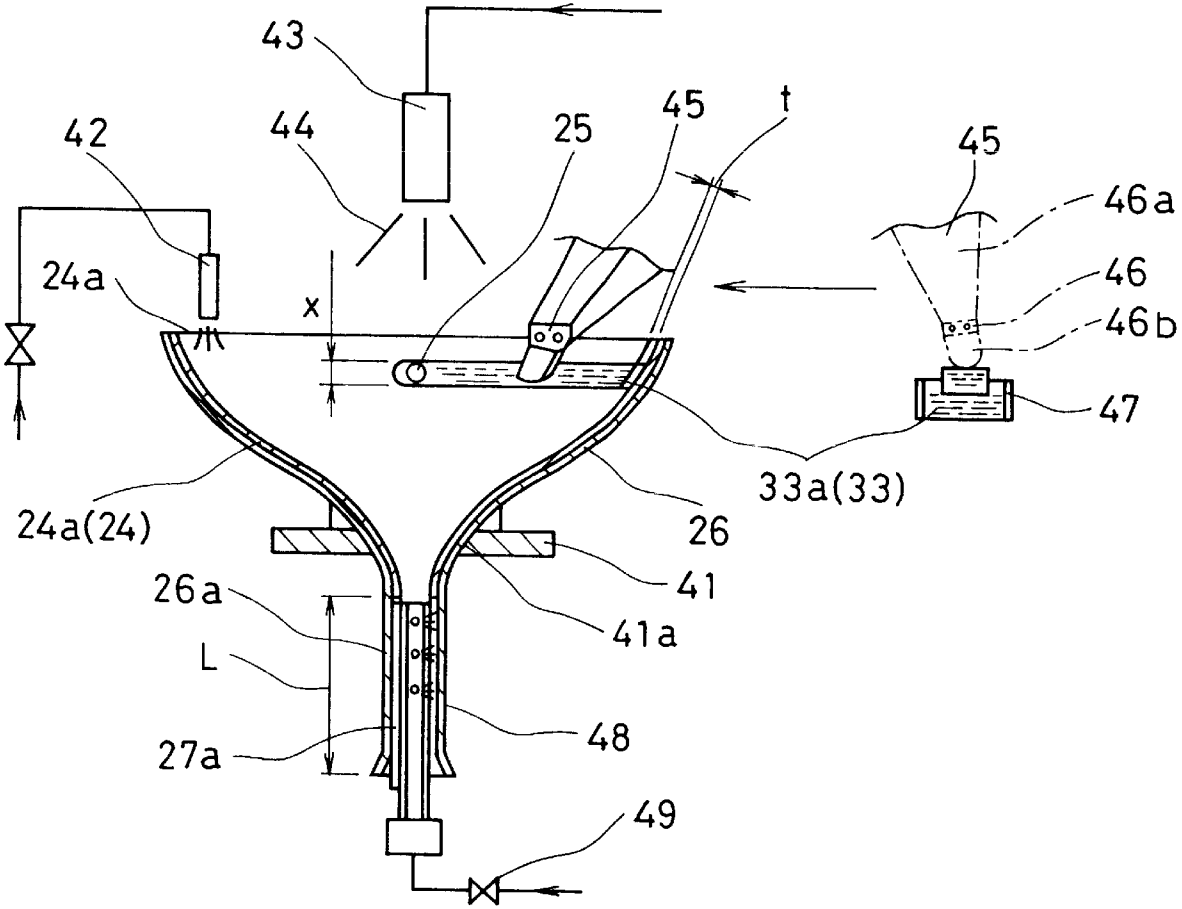
FIG. 3 is a cross-sectional view for explaining a method for manufacturing the cathode ray tube.

The following is an explanation of the conductive layer forming step performed using the conductive layer forming device shown in FIG. 3.

Firstly, in the funnel supporting step 35, the funnel 26 is placed in a hole 41*a* of a supporting stand 41.

Next, in the first applying step 36, the first conductive coating 24*a*, for example mainly containing graphite and titanium oxide, is injected through an injection nozzle 42 arranged above the supporting stand 41 so as to be applied to the entire area of the inner wall 23 of the funnel. As is shown in FIG. 1, the anode button 25 protrudes through the thickness of the first conductive layer 24. Therefore, the first conductive coating 24*a* does not attach to the tip of the protrusion of the anode button 25. When it happens, the attached first conductive coating 24*a* should be removed in this step.

In the first drying step 37, hot air 44 from an air nozzle 43 arranged above the supporting stand 41 is blown against the first conductive coating 24*a* applied to the entire area of the inner wall 23 of the funnel. In this manner, the first conductive coating 24*a* applied to the funnel 26 especially between the anode button 25 and the contact portion 31*a* is dried, thereby forming the first conductive layer 24. The first conductive layer 24 may be set to have a specific resistance of 1 to 3 Ωcm.

In the second applying step 38, a coating system 45 applies the second conductive coating 33*a*, for example mainly containing graphite having a specific resistance lower than that of the first conductive layer 24, onto the first conductive layer 24 formed on the inner wall 23 of the funnel. The range on which the second conductive coating 33*a* is applied is between the anode button 25 and the contact portion 31*a* of the first spring 31. In that range, the coating is made to the same plane. In addition, it is applied on the inner wall 23 of the funnel with less curved surface than the neck portion 26*a*. In this case, the second conductive coating 33*a* attaches to the tip of the protrusion of the anode button 25.

The coating system 45 includes an applicator 46 for applying the second conductive coating 33*a*, a coating supplying tool 47 for supplying the second conductive coating 33*a* to the applicator 46 and a moving mechanism (not shown). The moving mechanism moves the applicator 46 from the coating supplying tool 47 to the first conductive layer 24 on the inner wall 23 of the funnel so that the applicator 46 contacts, for example, the first conductive layer 24 around the anode button 25. Subsequently, the moving mechanism moves the applicator 46 from the anode button 25 to the contact portion 31*a* and applies the second conductive coating 33*a*.

The applicator 46 includes a supporting portion 46*a* made of a plate elastic body with a thickness of 2 to 5 mm and an applying portion 46*b* that is made of materials such as a vinyl acetate sponge with high hygroscopicity and durability and disposed on one edge portion of the supporting portion 46*a*. After the applying portion 46*b* absorbs and holds the second conductive coating 33*a*, the moving mechanism moves the applicator 46, thereby applying the conductive coating.

In the present embodiment, the second conductive coating 33*a* is applied on the first conductive layer 24 from the anode button 25 to the contact portion 31*a* of the first spring 31, with a thickness t of 2 to 6 $\mu$m and a width X of 20 to 40 mm.

In the second drying step 39, hot air 44 from the same air nozzle 43 as in the first drying step 37 can be blown against to dry the second conductive coating 33*a* applied on the first conductive coating 24, thereby forming the second conductive layer 33. The portion between the anode button 25 and the contact portion 31*a* of the first spring 31 is set to have a contact resistance of 0.1 to 1 kΩ.

Figure 4:
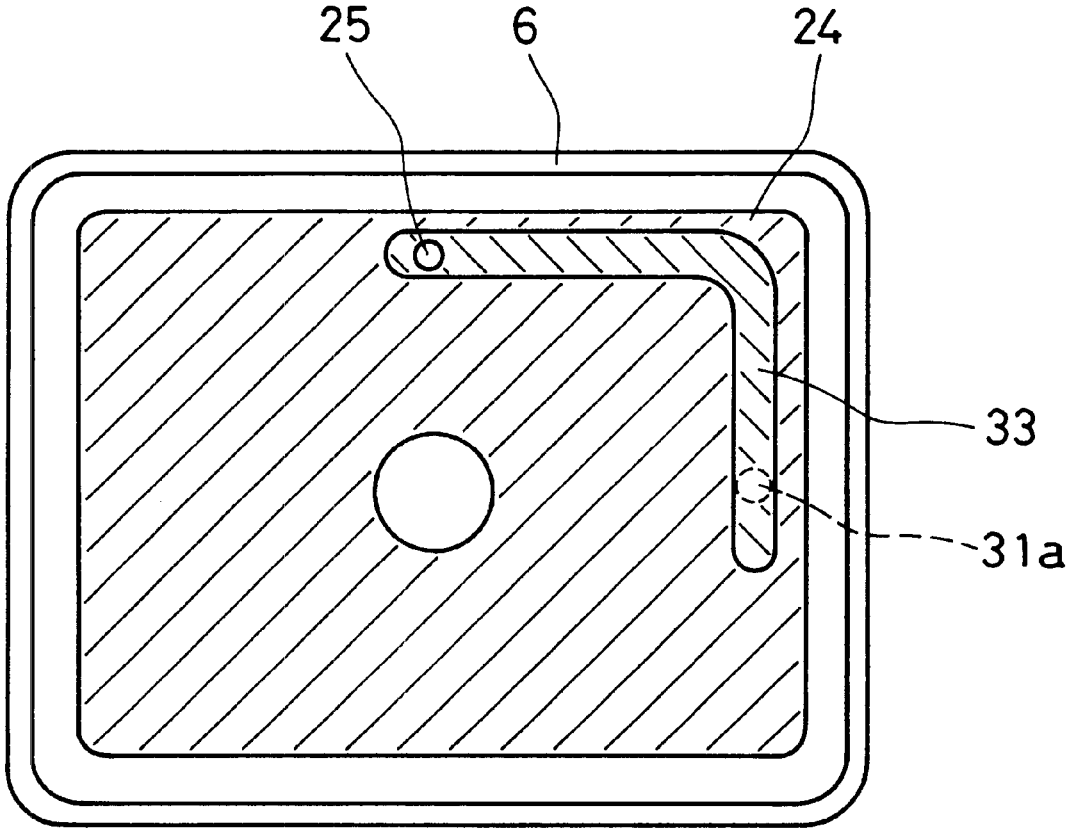
FIG. 4 is an enlarged view illustrating the inner surface of the funnel of the cathode ray tube.

In the coating removing step 40, the first conductive layer 24 applied to the neck portion 26*a* of the funnel 26 is removed, thereby completing the funnel 26, such as shown in FIG. 4, having the first conductive layer 24 and the second conductive layer 33. This coating removing step 40 can be conducted using a removing element 27*a* and a washing element 49. The removing element 27*a* mechanically removes the first conductive layer 24*a* applied to the neck portion 26*a* from a predetermined range L extending from the end of the neck portion 26*a*. The washing element 49 sprays wash water 48 to the inner surface of the neck portion 26*a*.

In the above embodiment, the second drying step 39 is followed by the coating removing step 40. However, the coating removing step 40 may be between the first drying step 37 and the second applying step 38.

The following is an explanation of the effects in accordance with the above configuration.

In the color cathode ray tube according to the embodiment described above, the second conductive layer 33 is formed on a single surface of the first conductive layer 24 and on the portion of the inner wall 23 of the funnel between the anode button 25 and the contact portion 31*a* of the first spring 31 with less curved surface than the neck portion 26*a*. Thus, the connection of the first conductive layer 24 and the second conductive layer 33 is firm. As a result, the problems such as poor conductivity between the first conductive layer 24 and the second conductive layer 33 with different specific resistance, clogs of apertures of the shadow mask 28 due to shedding off of layers and electric discharges in the tube are solved. In addition, the second conductive layer 33 is formed on the first conductive layer 24 that is formed on a substantially flat portion of the inner wall 23 of the funnel, leading to a simplification of the manufacturing steps.

Since the second conductive layer 33 has a specific resistance lower than that of the first conductive layer 24, a current pulse, which is generated when an electron beam collides with the shadow mask 28, easily runs from the anode button to the contact portion of the first spring via the second conductive layer as a lower resistance portion. Consequently, the emission of electric field is suppressed, thus reducing the leakage electric field. In addition, with the first conductive layer 24 that forms a higher resistance portion contacting the contact portion of the final electrode 30*a*, the maximum instantaneous current generated between electrodes in the bulb at the time of a spark can be reduced.

By setting the first conductive layer 24 to have a specific resistance of 1 to 3 Ωcm, even when, for example, a high voltage of 20 to 50 kV is applied to the anode button 25, the maximum instantaneous current generated between electrodes in the bulb at the time of a spark is reduced. As a result, malfunctioning and breaking of individual circuit components in TV sets are prevented.

Also, by setting the second conductive layer 33 to have a specific resistance of 0.05 to 0.2 Ωcm, the leakage electric field value is reduced to 1.0 V/m or less in a color cathode ray tube with a horizontal deflection frequency band of 2 to 400 kHz. Thus, VLEF standards can be met.

Next, the following is a working example conducted in order to confirm the effects of the present invention.

As the working example of the present invention, a 51-cm (17-inch) cathode ray tube for computer display having the configuration shown in FIG. 1 was produced. The first conductive layer 24 had a specific resistance of 1.5 Ωcm, and the second conductive layer 33 had a specific resistance of 0.1 Ωcm.

Figure 5:
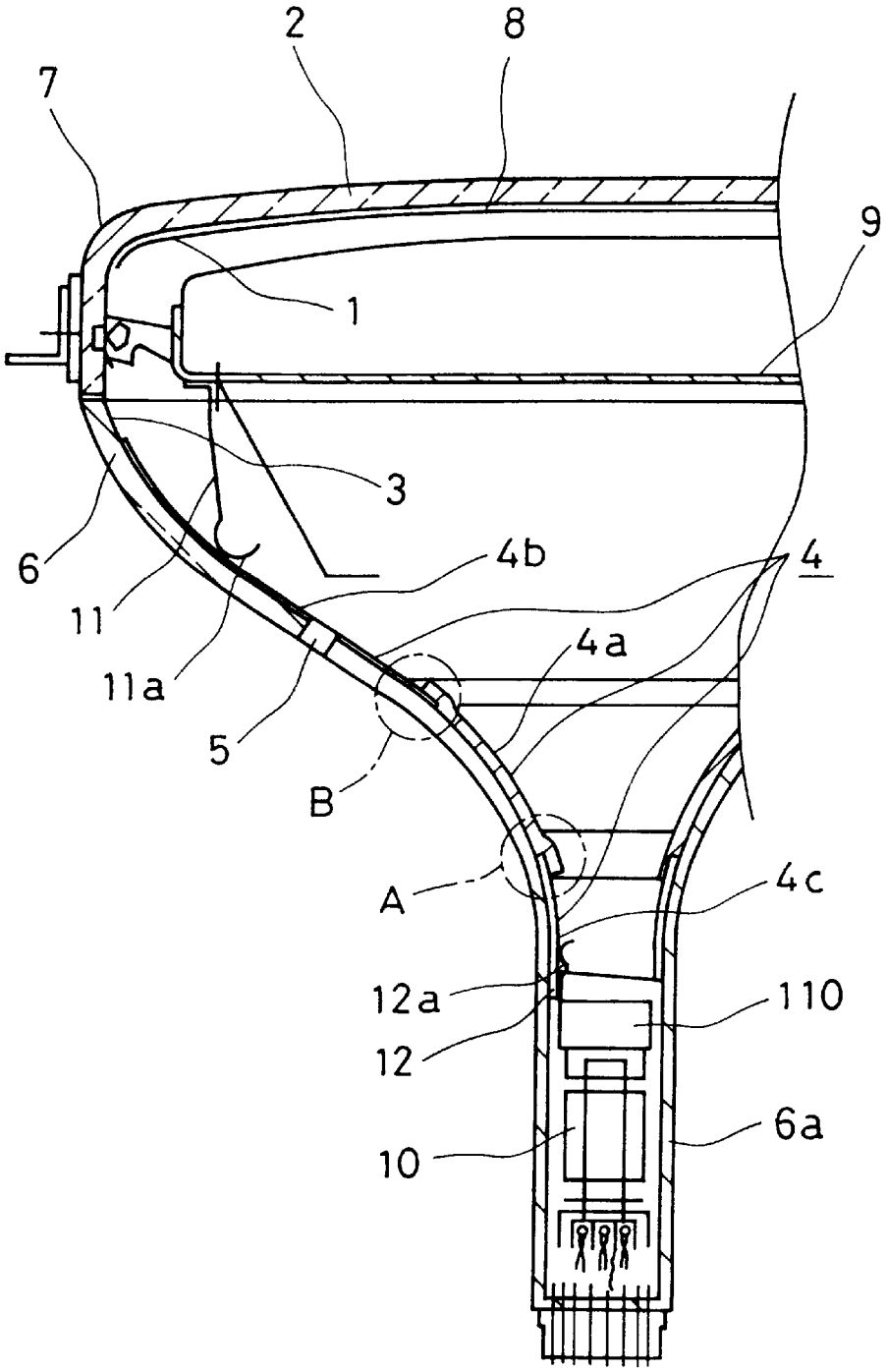
FIG. 5 PRIOR ART
FIG. 5 is a cross-section showing a color cathode ray tube of the prior art.

As a comparative example of a conventional device, a color cathode ray tube with the configuration shown in FIG. 5 was produced. The conductive layers 4*b* and 4*c* were made of the same material as the second conductive layer 33 of the working example, with a specific resistance of 0.1 Ωcm. The conductive layer 4*a* was made of the same material as the first conductive layer 24 of the working example, with a specific resistance of 1.5 Ωcm.

In the working example and the comparative example, a high voltage of 25 kV was applied to respective anode buttons 25, and the cathode ray tubes were operated in a horizontal deflection frequency band of 68.8 kHz (a general horizontal frequency band for a television receiver). A leakage electric field value and a connection defect between the anode button and the contact portion of the first spring were examined in 30000 samples. Also, a maximum instantaneous current in a bulb at the time of electric discharge was examined in 20 samples. The result is described in the following. The leakage electric field value was measured in front of the panel surface of the color cathode ray tube at a distance of 30 cm.

In the working example, a mean value of the leakage electric field with a horizontal deflection frequency of 2 to 400 kHz was 0.8 V/m and a variance δ thereof was 0.1 V/m. On the other hand, in the comparative example, the mean value was 1.8 V/m and the variance δ was 0.4 V/m. This shows that the working example is advantageous over the comparative example in that VLEF standards of the leakage electric field value can be met and, moreover, the variance of the electric field value is smaller.

In addition, with respect to poor conductivity between the anode button and the contact portion of the first spring, the working example had no defective product. On the contrary, the comparative example had 8 defective products. This indicates that the working example is advantageous over the comparative example in that the conductivity between the anode button and the first spring via the conductive layer has been improved.

Furthermore, in terms of the maximum instantaneous current, the working example showed approximately 100 A, while the comparative example showed 130 A. The result shows that the working example is advantageous over the comparative example in that the maximum instantaneous current generated in a bulb at the time of electric discharge can be reduced.

The invention may be embodied in other specific forms without departing from the spirit or essential characteristics thereof. The embodiments disclosed in this application are to be considered in all respects as illustrative and not restrictive, the scope of the invention being indicated by the appended claims rather than by the foregoing description, all changes that come within the meaning and range of equivalency of the claims are intended to be embraced therein.

What is claimed is:

1. A color cathode ray tube comprising:

a bulb having a panel with a phosphor screen disposed on an inner surface of said panel and a funnel;

a shadow mask structure having a shadow mask that is provided in opposition to the phosphor screen on the inner surface of said panel;

an electron gun enclosed in a neck portion of said funnel;

a conductive layer provided on an inner wall of said funnel;

an anode button provided in said funnel and used for applying high voltage to said conductive layer;

a first spring supported by said shadow mask structure and having a contact portion that is biased against said conductive layer; and a second spring supported by a final electrode of said electron gun and having a contact portion that is biased against said conductive layer;

wherein said conductive layer comprises a first conductive layer and a second conductive layer having a lower specific resistance than said first conductive layer, said first conductive layer is formed on an entire range of the inner wall of said funnel to be provided with said conductive layer, and said second conductive layer is formed on said first conductive layer within a range from said anode button to the contact portion of said first spring, and the contact portion of said first spring contacts said second conductive layer, thereby electrically connecting said shadow mask structure to said second conductive layer, and the contact portion of said second spring contacts said first conductive layer, thereby electrically connecting the final electrode to said first conductive layer.

2. The cathode ray tube according to claim 1, wherein said first conductive layer has a specific resistance of 1 to 3 Ωcm.

3. The cathode ray tube according to claim 2, wherein said second conductive layer has a specific resistance of 0.05 to 0.2 Ωcm.

4. The cathode ray tube according to claim 1, wherein said first conductive layer is made of a material mainly containing graphite and titanium oxide and said second conductive layer is made of a material mainly containing graphite.

5. A method for manufacturing a color cathode ray tube including:

a bulb having a panel with a phosphor screen disposed on an inner surface of said panel and a funnel;

a shadow mask structure having a shadow mask that is provided in opposition to the phosphor screen on the inner surface of said panel;

an electron gun enclosed in a neck portion of said funnel;

a conductive layer provided on an inner wall of said funnel;

an anode button provided in said funnel and used for applying high voltage to said conductive layer;

a first spring supported by said shadow mask structure and having a contact portion that is biased against said conductive layer; and a second spring supported by a final electrode of said electron gun and having a contact portion that is biased against said conductive layer;

wherein said conductive layer comprises a first conductive layer and a second conductive layer having a lower specific resistance than said first conductive layer, said first conductive layer is formed on an entire range of the inner wall of said funnel to be provided with said conductive layer, and said second conductive layer is formed on said first conductive layer within a range from said anode button to the contact portion of said first spring, and the contact portion of said first spring contacts said second conductive layer, thereby electrically connecting said shadow mask structure to said second conductive layer, and the contact portion of said second spring contacts said first conductive layer, thereby electrically connecting the final electrode to said first conductive layer, the method including the steps of forming said first and second conductive layer, comprising:

forming said first conductive layer on the inner wall of said funnel;

applying a conductive coating with a lower specific resistance than said first conductive layer on said first conductive layer between said anode button and the contact portion of said first spring; and drying said conductive coating to form said second conductive layer.

* * * * *